US010377605B2

(12) United States Patent
Puranen et al.

(10) Patent No.: US 10,377,605 B2
(45) Date of Patent: Aug. 13, 2019

(54) ROPE AND ROPE GROOVE MONITORING

(71) Applicant: KONE Corporation, Helsinki (FI)

(72) Inventors: Mikko Puranen, Riihimäki (FI); Pentti Alasentie, Espoo (FI)

(73) Assignee: KONE CORPORATION, Helsinki (FI)

( * ) Notice: Subject to any disclaimer, the term of this patent is extended or adjusted under 35 U.S.C. 154(b) by 464 days.

(21) Appl. No.: 15/206,750

(22) Filed: Jul. 11, 2016

(65) Prior Publication Data

US 2017/0043977 A1 Feb. 16, 2017

(30) Foreign Application Priority Data

Aug. 12, 2015 (EP) ..... 15180750

(51) Int. Cl.

| | |
|---|---|
| ***B66B 5/00*** | (2006.01) |
| ***B66B 5/02*** | (2006.01) |
| *B66B 7/12* | (2006.01) |
| *B66B 15/02* | (2006.01) |
| *B66B 15/04* | (2006.01) |

(52) U.S. Cl.

CPC ..... *B66B 5/0025* (2013.01); *B66B 5/0031* (2013.01); *B66B 5/02* (2013.01); *B66B 7/1215* (2013.01); *B66B 15/02* (2013.01); *B66B 15/04* (2013.01)

(58) Field of Classification Search

USPC ..... 187/391

See application file for complete search history.

(56) References Cited

U.S. PATENT DOCUMENTS

| | | | | |
|---|---|---|---|---|
| 5,731,528 | A * | 3/1998 | Yamazaki | G01L 5/042 73/828 |
| 6,569,046 | B1 * | 5/2003 | Gregg | F16G 1/28 474/102 |
| 7,461,721 | B2 * | 12/2008 | Aulanko | B66B 15/04 187/251 |
| 7,715,026 | B2 * | 5/2010 | Nayebi | B61K 9/12 356/237.1 |
| 8,319,621 | B2 * | 11/2012 | Kikuchi | B60C 23/04 340/438 |
| 2009/0039326 | A1 * | 2/2009 | Triolier | B61B 12/06 254/391 |
| 2011/0259676 | A1 * | 10/2011 | Nardi | B66B 15/04 187/250 |
| 2017/0169145 | A1 * | 6/2017 | Ehmke | G01M 17/10 |

FOREIGN PATENT DOCUMENTS

| | | | |
|---|---|---|---|
| EP | 1 732 836 | A2 | 12/2006 |
| EP | 2 497 741 | A1 | 9/2012 |
| JP | 2013-18643 | A | 1/2013 |
| SU | 581072 | A1 | 11/1977 |
| WO | WO 2005/097651 | A2 | 10/2005 |

* cited by examiner

*Primary Examiner* — Christopher Uhlir

(74) *Attorney, Agent, or Firm* — Birch, Stewart, Kolasch & Birch, LLP

(57) ABSTRACT

Modern elevators involve a plurality of ropes and wheels for ropes in a variety of different functions related to the operation and security of an elevator. The wearing of a rope and a wheel may be inspected by scanning a profile of a wheel or ropes on a wheel. When a rope or a wheel is worn the profile will be lower than in the normal situation. Depending on the difference to the normal situation an appropriate action may be taken.

16 Claims, 3 Drawing Sheets

ROPE AND ROPE GROOVE MONITORING

FIELD

The rope and groove monitoring disclosed in this application relates to elevators and particularly to monitoring ropes and different wheels for ropes that may be worn during operation.

BACKGROUND

An elevator involves a plurality of different ropes and means for operating ropes. For example, hoisting ropes are connected to a traction sheave that and are arranged to move an elevator car according to the placed calls. Other examples of ropes are suspension ropes and ropes of the overspeed governor, which is arranged to monitor speed of the elevator car and to stop the elevator car if it is running too fast.

Ropes and wheels for operating the ropes in an elevator are susceptible to wearing. As the ropes and operating configuration vary in different functions also the type of wearing varies and different methods for controlling different ropes are used. For example, ropes can be inspected manually by visual inspection by checking the strands of the ropes or by measuring the diameter of the rope. A visual view of an experienced maintenance person is also commonly used evaluation method. The inspection of a traction sheave or a pulley is even more complicated when the shape of a groove in a traction sheave, a pulley or other wheel needs to be inspected.

When the rope or groove is worn issues critical to the security of an elevator may arise. For example, in case of overspeed governor a worn groove or rope may change the triggering speed or even fail completely. Furthermore, even if other safety mechanisms could prevent the possible danger, failures will cause additional expenses and out of service time that might be very inconvenient particularly in buildings that are served only by one elevator.

It is commonly known that there are regulations with regard ropes that vary country by country. Thus, different configurations may be used in different elevators. For example, it is normal that the traction sheave of the hoisting machine is configured to operate a plurality of ropes while the overspeed governor may be operated by one rope. The materials and dimensions of the ropes may vary based on the elevator car size. Different configurations may cause additional work in inspection.

SUMMARY

An arrangement for an elevator is disclosed. Modern elevators involve a plurality of ropes and wheels for ropes in a variety of different functions related to the operation and security of an elevator. The wearing of a rope and a wheel may be inspected by scanning a profile of a wheel or ropes on a wheel. When the rope or the wheel is worn the profile will be lower than in the normal situation. Depending on the difference to the normal situation an appropriate action may be taken.

In an embodiment a method for elevator maintenance is disclosed. In the method at least one reference profile of a rope wheel or a rope arranged on a wheel is determined and a profile of the wheel or the rope on a wheel is scanned. Then the scanned profile is compared to the reference profile. Based on the comparing result, an action is launched when the comparison result indicates a possible rope or wheel wearing.

Reference profiles can be received from an external device or be computed from the measured profile. Based on the comparison an appropriate action, such as sending an information message, launching an alarm or preventing the operation of the elevator, may be taken. The monitoring can be continuous or based on time interval or a request from an external device.

In an embodiment the method described above is implemented as a computer program that is executed in a computing device, such as a controller, server or similar. The computing device is connected to a scanning device so that the rope and the respective wheel can be scanned. The scanning device may be two-dimensional or three-dimensional scanner or any other device capable of scanning the profile of the rope and the wheel. The computing device and scanner are arranged to an elevator so that the monitoring of ropes of an elevator can be performed. The ropes may be suspension ropes, hoisting ropes, overspeed governor ropes or any other ropes used in an elevator. The computing device may be equipped with a network connection so that the information may be transmitted to the maintenance center or other central location.

The benefits of the embodiments mentioned above include cost effective and reliable monitoring of the ropes and the respective wheel. The use of arrangement described above provides cost savings in the elevator maintenance by providing accurate up to the date information to maintenance persons so that the elevator can be kept safe and operating by correct maintenance. Furthermore, the arrangement is compatible with conventional security systems. Thus, the arrangement described above will lead also improved security of the operation. A further benefit is that as the maintenance time is reduced and the maintenance can be more often done before the elevator is stopped, the operation time of the elevator is increased. This is very desirable and reduces inconveniences especially in buildings or locations that are served by one elevator only.

BRIEF DESCRIPTION OF THE DRAWINGS

The accompanying drawings, which are included to provide a further understanding of the rope and rope groove monitoring and constitute a part of this specification, illustrate embodiments of the rope and rope groove monitoring and together with the description help to explain the principles of the rope and rope groove monitoring. In the drawings.

DETAILED DESCRIPTION

Reference will now be made in detail to the embodiments of the rope and rope groove monitoring, examples of which are illustrated in the accompanying drawings.

Figure 1:
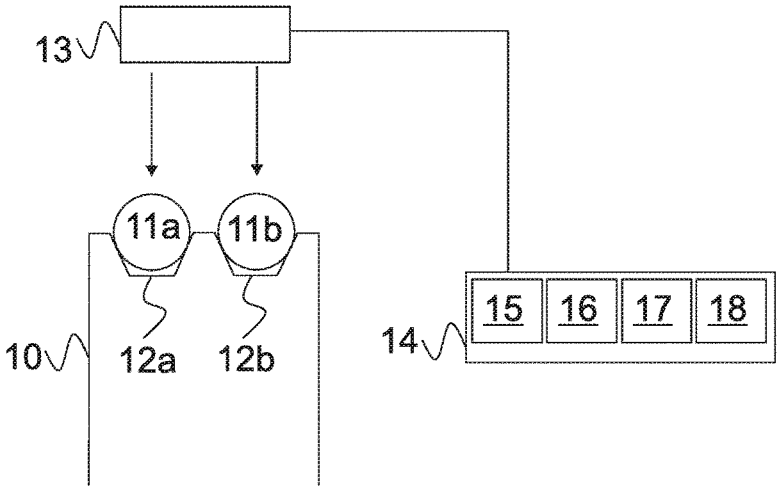
FIG. 1 is a block diagram of an example embodiment.

In FIG. 1 a block diagram of an embodiment. In the embodiment a wheel 10 is illustrated so that two ropes 11*a* and 11*b* are arranged to go around the wheel 10. The wheel is a pulley, traction sheave or any other sheave and it is connected to an axle or a shaft so that the wheel may rotate.

For example, in case of a traction sheave of a hoisting machine the shaft is connected to the hoisting machine and ropes 11 are hoisting ropes of the elevator and the traction sheave is configured to move the ropes so that the elevator moves according to the instructions given by the passengers. However, it is possible that a pulley is connected with bearings to the shaft and thus it will rotate when a rope moves around the pulley. It is common to all embodiments that the wheel 10 is rotating when the rope or ropes going around the wheel 10 are moving. The wheel 10 comprises at least one groove 12*a*, 12*b* so that the rope, when in use, is supported by the groove.

In the figure a scanner 13 is arranged so that it can analyze the ropes 11 and the wheel 10. For example, the scanner 13 may be a 2D laser scanner that is configured to scan the profile of the ropes that are located in the grooves 12*a* and 12*b* respectively. The scanned profile is sent from the scanner 13 to a computing device 14, such as a controller, computer, server or similar, for further analysis. The analysis if performed by comparing the scanned profile to a reference profile. For example, if the comparison reveals that the scanned profile is lower than the reference profile it means that either the diameter of the rope is smaller than before or the rope is located lower in the groove because the bottom and/or walls of the groove have been worn. Both situations may be such that the ropes 11 and/or the wheel 10 need to be changed or at least checked by a maintenance person.

In the embodiment of FIG. 1 a two-dimensional laser scanning unit is used as it is cheap and reliable and provides results that can be used in the determination of rope and/or wheel wearing. The laser scanner can be operated automatically or when requested by a maintenance person. Thus, it is suitable for continuous monitoring if the laser scanner is arranged permanently to an elevator being monitored. Also other measuring devices may be used instead of two-dimensional laser scanner when they provide results from where it can be determined that the profile of the rope is located lower as it was before.

In FIG. 1 the computing device 14 is a server comprising at least one processor 15, at least one memory 16 and at least one device for reading a computer readable medium 17 such as USB reader for a memory stick and a network connection 18. The at least one processor 15 is configured to execute programs stored into the at least one memory 16. The at least one memory 16 is further configured to store data. The at least one device for reading a computer readable medium 17 may be used for storing necessary computer programs and reference profiles to the computing device 14. The network connection 18 may be a fixed or wireless network communication that may be shared with other functionality of the computing device 14. The network connection may be used, for example, for exchanging data with other systems, launching an alarm or providing instructions.

Figure 2A:
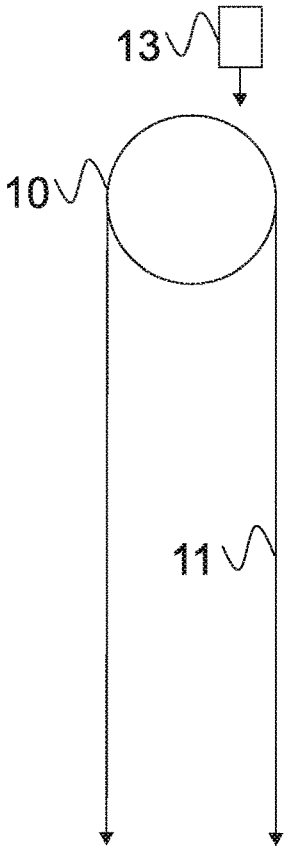
FIG. 2*a* is another block diagram of an example embodiment.

FIG. 2*a* discloses another view of the wheel 10 of FIG. 1. In FIG. 2 scanner 13 is shown above the wheel 10 and ropes 11 are shown from a direction where it cannot be seen how many parallel ropes 11 are going around the wheel 10. Even if FIGS. 1 and 2 disclose an embodiment where the scanner is located above the wheel 10 it is possible that it is located in other position from where it is possible to scan the ropes 11. Furthermore, when the ropes 11 are going under the wheel 11 it is naturally possible to place the scanning device under the wheel 10. Different configurations depend on the wheel that is being inspected.

Figure 2B:
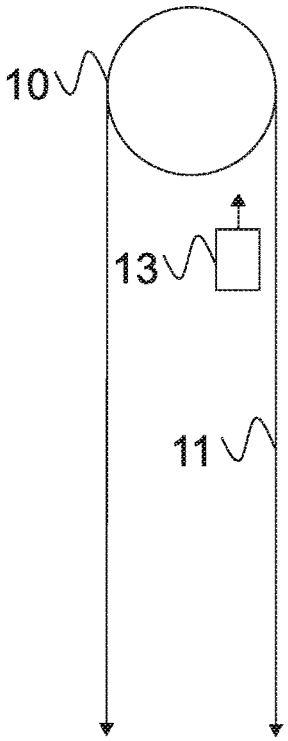
FIG. 2*b* is another block diagram of an example embodiment.

In FIG. 2*b* discloses an alternative embodiment where the wheel is scanned so that there is no rope 11 on the scanned part of the wheel 10. Even if a rope is shown in FIG. 2*b*, it can be completely removed for scanning.

Furthermore, scanning of the wheel 10 may be continuous so that the profile of the complete wheel 10 is acquired. From the profile of the complete wheel 10 the properties of the wheel 10 may be computed. In an embodiment it is possible to receive the position of the wheel from the rotating device or from a measurement device attached to the rotating device. For example, a rotary encoder or a similar device may be used for determining the location of the rotating shaft. For example, from the scanning results it is possible to determine if the wheel 10 is still round or of the same shape as in the beginning. The determination may be done based on computational models or by comparing to the original form as in the other cases mentioned above. The profile of the complete wheel can be scanned in both embodiments mentioned above. In a further embodiment a three-dimensional model is formed by combining the absolute or relative location of the rotating wheel with the scanning results. When the location information is known the scanning results can be positioned to a correct position on the wheel.

Furthermore, the embodiments disclosed in FIGS. 2*a* and 2*b* can be combined so that both the rope 11 and the wheel 10 are simultaneously scanned. This kind of a combined embodiment provides more information to the maintenance persons so that they can be better prepared before visiting the site.

Figure 3:
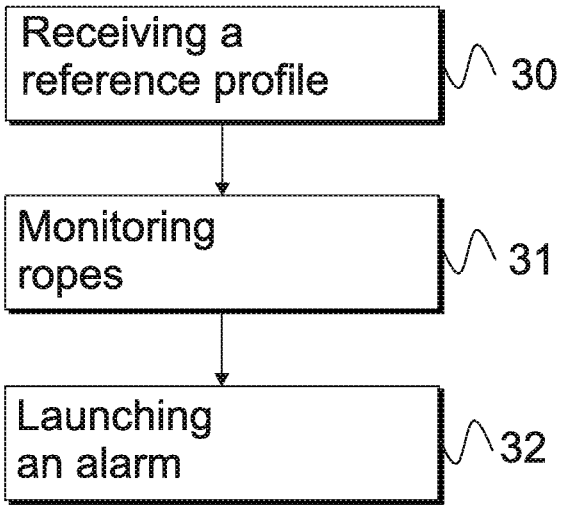
FIG. 3 is a flow chart of a method according to an example embodiment.

In FIG. 3 a method according to an embodiment is discussed. In the method of FIG. 3 the wheel is a pulley of an overspeed governor comprising one rope. The method may also be used in other embodiments. A two-dimensional laser scanner is arranged to inspect the wheel. The method is initiated by receiving a reference profile at the device controlling the measurement, step 30. The reference profile can be received, for example, from a computer readable medium such as a memory stick, or the maintenance person can retrieve the reference profile by using the internet connection of the controlling device. The reference profile of this example is a profile that is determined to be still acceptable in terms of wearing. The reference profile may be determined computationally or by teaching, for example in a form of neural network, wherein measuring a plurality of still acceptable ropes is accumulated in a neural network. Furthermore, as the ropes always include portions that do not wear because they do not pass the wheel it is possible to scan a reference profile also from the older ropes by placing a scanner appropriately for the measurement.

In the example of FIG. 3 ropes and the wheel are monitored continuously, step 31. Thus, the laser scanner is configured to perform scans continuously so that the information is achieved all possible locations on the rope. It is possible that the scanning is configured to be performed at predetermined intervals, such as once in an hour or once in a day. In another embodiment the scanner equipment is movable and a maintenance person brings the scanning equipment with him and performs the scanning when visiting an elevator to be inspected.

When the comparison against reference profile reveals that the rope and/or the wheel might not be acceptable anymore an alarm is launched, step 32. It is also possible to prevent the operation of the elevator. For example, it is possible to have to different reference profiles configured so that the first one causes an alarm and the second one, which corresponds with more severe wearing, causes prevention of the operation. Furthermore, if a learning system is used the alarm is classified so that the maintenance person decides if the alarm was correct and must me reacted or if it is still safe to use the rope and/or wheel. It is important to understand that the embodiment explained with regard to FIG. 3 requires that the reference profiles and measurements are done with similar wheel and rope pair.

Figure 4:
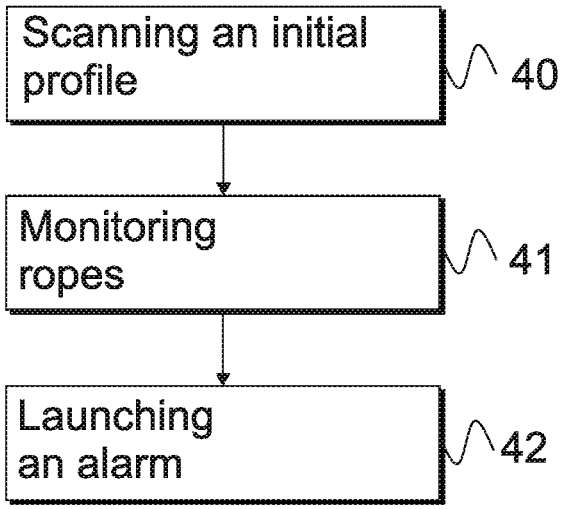
FIG. 4 is another method according to an example embodiment.

In FIG. 4 another method is disclosed. In the method the monitoring is initiated by scanning a new rope and wheel pair when it is installed, step 40. Then the scanning is performed as it was in the method discussed above with referral to FIG. 3. The monitoring step 41, where the wheel and ropes are compared is different to the method of FIG. 3 as there is no reference profile but the change is measured by comparing a difference between the initial profile and the scanned profile.

What is discussed above is suitable for various types of ropes and respective wheels. For example, the materials for both wheels and ropes may have an effect to wearing as the materials have different wearing propersties. A wheel made of steel wears differently to a plastic wheel. Furthermore, the original form of the groove has also an effect to wearing. Different types of grooves wear differently. The profile of the wheel is chosen on application basis and it is possible that the wheel does not have a groove for holding the rope. However, also in these cases it may be important to detect if the profile of the wheel has changed because worn wheel may accelerate the wearing of ropes.

Different rope and wheel combinations may have a further effect to the wearing. In these combinations the ropes may be, for example, full steel rope, fiber core rope, steel core rope, semi core rope, or any other suitable rope. Furthermore, the diameter of the rope varies according to the application. Typically the ropes are between 4-20 mm in elevator use, however, the arrangement described above is suitable also to other diameters. The ropes may also be of different shape instead of a conventional substantially round shape. For example, instead of a round shape a belt-shaped rope may be used. Some types of ropes involve a coating that is also susceptible to wearing. The wearing of coating may also be detected as a change of profile. Thus, there is a plurality of factors having an effect to the rope and rope wheel wearing. The rope and rope wheel monitoring principles explained above are applicable to all these combination.

In the description above embodiments with permanent scanner installations are discussed, however, it is also possible provide embodiments with temporary installations. For example, the maintenance person may bring a scanner arrangement when visiting the elevator to be tested. The scanner may be used during the visit or it may be left to the site so that the maintenance person will come and take it to the next elevator when visiting the elevator next time. Thus, also portable embodiments may be used for continuous monitoring or monitoring at regular intervals. Correspondingly permanent installations may be used so that the scanning is triggered by an excitation or a request received from an external system. For example, the maintenance person may want to do inspection before visiting the elevator so that he can bring all necessary spare parts and reserve enough time according to the required maintenance task.

The arrangements discussed above can be used for various maintenance purposes, which include measurements of rope diameter, monitoring shape and surface of a rope and monitoring the location of a rope in a wheel. For example, if a wheel is used for a plurality of hoisting ropes and some of the ropes wear faster than others it means that the load is not evenly distributed. This, however, can now be detected.

The method mentioned above may be implemented as computer software which is executed in a computing device. When the software is executed in a computing device it is configured to perform the above described method. The software is embodied on a computer readable medium so that it can be provided to the computing device, such as the computing device 14 of FIG. 1.

As stated above, the components of the exemplary embodiments can include computer readable medium or memories for holding instructions programmed according to the teachings of the embodiments and for holding data structures, tables, records, and/or other data described herein. Computer readable medium can include any suitable medium that participates in providing instructions to a processor for execution. Common forms of computer-readable media can include, for example, a floppy disk, a flexible disk, hard disk, magnetic tape, any other suitable magnetic medium, a CD-ROM, CD±R, CD±RW, DVD, DVD-RAM, DVD±RW, DVD±R, HD DVD, HD DVD-R, HD DVD-RW, HD DVD-RAM, Blu-ray Disc, any other suitable optical medium, a RAM, a PROM, an EPROM, a FLASH-EPROM, any other suitable memory chip or cartridge, a carrier wave or any other suitable medium from which a computer can read.

It is obvious to a person skilled in the art that with the advancement of technology, the basic idea of the rope and rope groove monitoring may be implemented in various ways. The rope and rope groove monitoring and its embodiments are thus not limited to the examples described above; instead they may vary within the scope of the claims.

The invention claimed is:

1. A method for elevator maintenance:

determining at least one reference profile of a wheel;

scanning a profile of said wheel;

comparing said scanned profile to the at least one reference profile; and reference based on the comparing result, launching an action when said comparison result indicates a possible wheel wearing, wherein a rope is arranged on said wheel.

2. The method according to claim 1, wherein said comparison result indicates a possible rope or wheel wearing.

3. The method according to claim 1, wherein said at least one reference profile is determined by computing a profile matching a largest allowed difference.

4. The method according to claim 1, wherein said at least one reference profile is received from an external device.

5. The method according to claim 1, wherein said action is dependent on the at least one reference profile and said action comprising one of the following: sending an information message, launching an alarm and preventing an operation of the elevator.

6. The method according to claim 1, wherein the scanning and comparing is performed continuously.

7. The method according to claim 1, wherein the scanning and comparing is performed at regular time intervals or upon a request received from an external system.

8. A computer program for a server comprising code adapted to cause the method according to claim 1 when executed on a data-processing system.

9. An apparatus comprising:

at least one processor;

at least one memory; and a controller, wherein the controller is configured to perform a method according to claim 1 by executing a computer program code stored in said at least one memory by said at least one processor.

10. The apparatus according to claim 9, wherein the apparatus further comprises at least one of the following: a device for reading a computer readable medium and a network connection.

11. A system comprising an apparatus according to claim 9 and at least one scanning device.

12. The system according to claim 11, wherein the at least one scanning device is a two-dimensional laser scanner.

13. The system according to claim 11, wherein said system further comprises a device configured to measure a location of where the wheel is being scanned.

14. An elevator comprising a system according to claim 11, wherein said at least one scanning device is configured to scan at least one of the following: hoisting ropes, overspeed governor ropes, suspension ropes and wheels.

15. The method according to claim 2, wherein said at least one reference profile is determined by computing a profile matching a largest allowed difference.

16. The method according to claim 2, wherein said at least one reference profile is received from an external device.

* * * * *